United States Patent [19]

Munro

[11] Patent Number: 4,505,687

[45] Date of Patent: Mar. 19, 1985

[54] FORM RETAINING STUFFED FIGURINE

[75] Inventor: Joan C. Munro, River Vale, N.J.

[73] Assignee: American Greetings Corporation, Cleveland, Ohio

[21] Appl. No.: 523,289

[22] Filed: Aug. 15, 1983

[51] Int. Cl.[3] ..... A63H 3/00; A63H 33/00

[52] U.S. Cl. ..... 446/368; 446/369; 446/385; 446/486; 446/26

[58] Field of Search ..... 46/115, 123, 151, 152, 46/154, 160, 162; 2/406, 407; 63/11; 446/268, 368, 369, 370, 371, 372, 373, 385, 486, 26

[56] References Cited

U.S. PATENT DOCUMENTS

| | | | |
|---|---|---|---|
| 240,096 | 4/1881 | Crane | 63/11 |
| 243,704 | 7/1881 | Howe | 63/11 |
| 788,221 | 4/1905 | Richardson | 63/11 |
| 2,830,402 | 4/1958 | Schleich | 46/119 |
| 2,853,831 | 9/1958 | Bischoff | 46/123 |
| 3,097,446 | 7/1963 | Packer | 46/123 |
| 3,448,539 | 3/1966 | Hartpence | 46/156 |
| 3,557,436 | 1/1971 | Hodes | 29/428 |
| 3,928,933 | 12/1975 | Iwamoto | 46/119 |
| 3,942,283 | 3/1976 | Rushton | 46/154 |
| 4,170,086 | 10/1979 | Hills | 46/158 |
| 4,226,046 | 10/1980 | Delhome | 46/123 |

FOREIGN PATENT DOCUMENTS

| | | | |
|---|---|---|---|
| 657031 | 2/1963 | Canada | 46/35 |
| 922397 | 6/1947 | France | 46/162 |

*Primary Examiner*—Richard T. Stouffer
*Assistant Examiner*—Daniel Nolan
*Attorney, Agent, or Firm*—Maky, Renner, Otto & Boisselle

[57] ABSTRACT

A figurine having a form retaining shape. The figurine comprises a body portion and a head portion connected with the body portion. The body portion comprises (i) a tubular outer covering, (ii) a fill material substantially filling the tubular outer covering, and (iii) a piece of elastic extending along at least a part of the tubular outer covering. The piece of elastic is in a partially tensioned state resulting from being fixedly secured under a state of high tension to at least two points spaced apart along the length of the tubular covering and then being allowed to relax to a partially tensioned state and being held in the partially tensioned state by the tubular outer covering. The piece of elastic allows the body portion to be manually deformed against that bias. The piece of elastic returns the body portion to the predetermined shape when the deforming forces are removed.

10 Claims, 7 Drawing Figures

FORM RETAINING STUFFED FIGURINE

BACKGROUND OF THE INVENTION

The present invention relates to a form retaining stuffed figurine. It relates particularly to a stuffed figurine with form retaining characteristics that allow it to be secured to an object such as a person's arm.

In the art, there are various types of figurines that have a form retaining shape, for allowing them to be secured to an object. Two known types of form retaining figurines are shown in U.S. Pat. Nos. 3,928,933 and 3,448,539. In those patents, a mechanical spring biases the limbs of the figurine to a gripping configuration. The limbs are urged against the spring bias either by manipulating a clip secured to the body of the figurine (U.S. Pat. No. 3,928,933) or by manipulating the springs themselves (U.S. Pat. No. 3,448,539). The limbs are urged against the spring bias in order to (i) disengage the limbs from an article, or (ii) separate the limbs to allow them to grip an article.

Other types of form retaining figurines are shown in U.S. Pat. No. 4,226,046. That patent discusses specific drawbacks of form retaining figurines that utilize mechanical springs and clips, and discloses several ways of constructing a form retaining figurine without mechanical springs and clips. In all of the disclosed figurines, the body of the figurine is formed by a body of resiliently deformable material such as a polyurethane foam, and the patent discusses several ways of maintaining the resliently deformable material in a predetermined shape. According to the patent, the simplest way is to either (i) cut the shape from a block of foam or (ii) mold the foam into the shape. The inherent resiliency of the foam is used to maintain the body in the predetermined shape. Another way is to form the foam into a blank (e.g., an H-shaped blank) and either (i) wind the blank onto a heated cylinder, (ii) secure to a surface of the blank a similar shaped stretched rubber strip and allow the rubber strip to curl the blank into a gripping shape, or (iii) stick to the surface of the blank a thermo retractable sheet and heating the sheet to cause it to curl the blank into a gripping shape.

Still another type of form retaining figurines is shown in Canadian Pat. No. 657,031. The figurine essentially comprises an inflatable material that is inflated to its form retaining shape and is maintained in that shape by the inflating medium.

SUMMARY OF THE INVENTION

This invention provides a new concept for a form retaining figurine which (i) does not include mechanical springs and clips, and (ii) does not require a special body of resiliently deformable material such as the foam material of U.S. Pat. No. 4,226,046. The principles of the invention can be used to form many different types of figurines out of a variety of simple and inexpensive components. In fact, the principles of the invention can be used to form figurines of relatively complex shapes, as seen from the preferred embodiment described below.

According to a broad aspect of the invention, a stuffed figurine has a head portion and a body portion. The body portion includes a form retaining component comprising a tubular, longitudinally extending outer covering made of a compliant material (preferably fabric), and a filling (e.g., cotton, nylon, fiber fill) disposed within the tubular outer covering. A band (length) of elastic extends longitudinally along a portion of the tubular outer covering, and is in a partially tensioned state resulting from being fixedly secured, under a state of high tension, to at least two longitudinally spaced portions of the tubular covering and then being allowed to partially relax to a partially tensioned state and being held in that partially tensioned state by the tubular covering. The band of elastic is preferably sewn to the tubular outer covering, under high tension, along a seam formed in the tubular outer covering. The band of elastic, when in the partially tensioned state, biases the tubular form retaining component into a predetermined geometric form. The form retaining component is manually deformable, against the bias of the band of elastic, and the band of elastic causes the component to return to its predetermined geometric form when the forces causing the deformation are removed.

In a particularly new and useful preferred embodiment, the form retaining component is formed into a coil. The tubular outer covering is formed into the shape of a coil by a series of C-shaped sections of fabric that are secured (preferably sewn) together. The coil has an outer periphery and an inner periphery, and the band of elastic is secured to the tubular outer covering, along the inner periphery of the coil. This provides the figurine's body with a tight coiled configuration, thus enabling the figurine to be securely wound about an object.

With the invention, the elasticity of the form retaining component is essentially provided by the band of elastic. The remaining materials (i.e., fabric, fill) that make up the component do not have to be formed of a special resiliently compressible material (e.g., foamed material, as in U.S. Pat. No. 4,226,046). Indeed, they can even be essentially inelastic. Thus, the variety of different materials that can be used to form a form retaining component according to the invention is believed to be greater than the variety of materials that can be used for a figurine according to U.S. Pat. No. 4,226,046. A figurine made according to the invention is also cost efficient in relation to a figurine made according to U.S. Pat. No. 4,226,046 because very inexpensive materials can be used for the fabric, fill and elastic that are used to form the figurine.

BRIEF DESCRIPTION OF THE DRAWINGS

The further objects and advantages of the invention will become further apparent from the following detailed description taken with reference to the accompanying drawings wherein.

DESCRIPTION OF A PREFERRED EMBODIMENT

Figure 1:
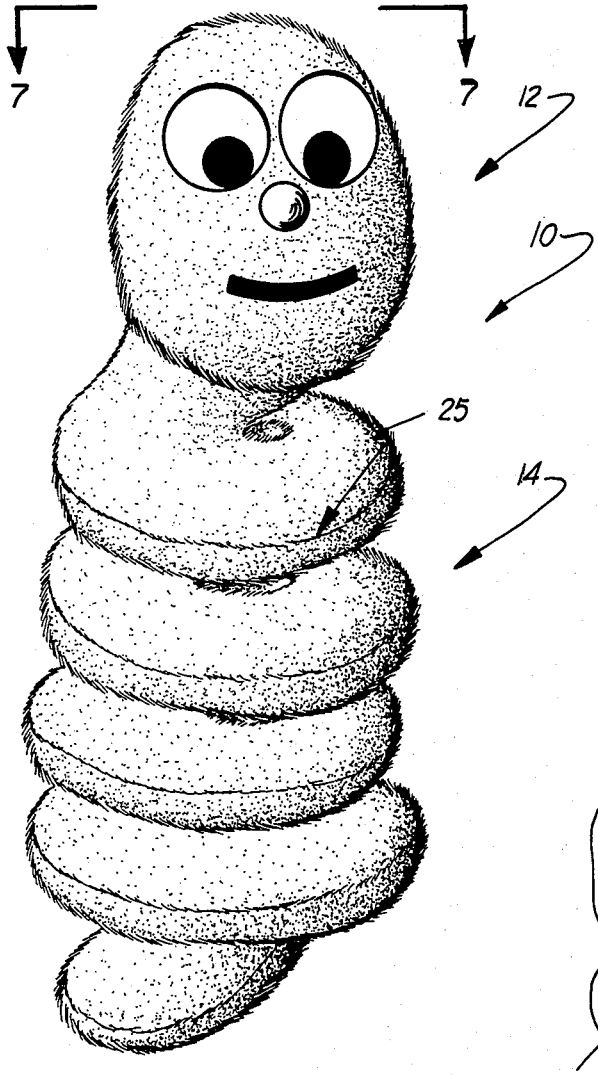
FIG. 1 is a three dimensional view of a coiled stuffed figurine incorporating the principles of this invention.

FIG. 1 shows a coiled stuffed figurine 10 formed according to the principles of this invention. The figurine includes a head portion 12, and a body portion 14 attached to the head portion. The body portion 14 has a circular coiled (or spiral) configuration, and is retained in the coiled configuration by the structure described below. The body portion 14 can be partially uncoiled (FIG. 5), by application of manual forces, and will return to its coiled position when the force is removed. Further, the body portion 14 can be coiled around an object such as a person's arm (FIG. 6), and will securely grip the object.

The coiled body portion 14 comprises an elongated, longitudinally extending tubular outer covering 16 that that is preferably formed of a compliant fabric material 17. It has a longitudinal axis 20 that extends lengthwise along the coils of the body portion 14. The fabric material 17 is formed into the tubular configuration and is retained in that tubular configuration by being sewn along one or more longitudinally extending seams. In the disclosed embodiment, the fabric 17 is sewn along two longitudinal seams; an outer seam 25 extending along the outer periphery of the coil and an inner seam 23 extending along the inner periphery of the coil.

Figure 4:
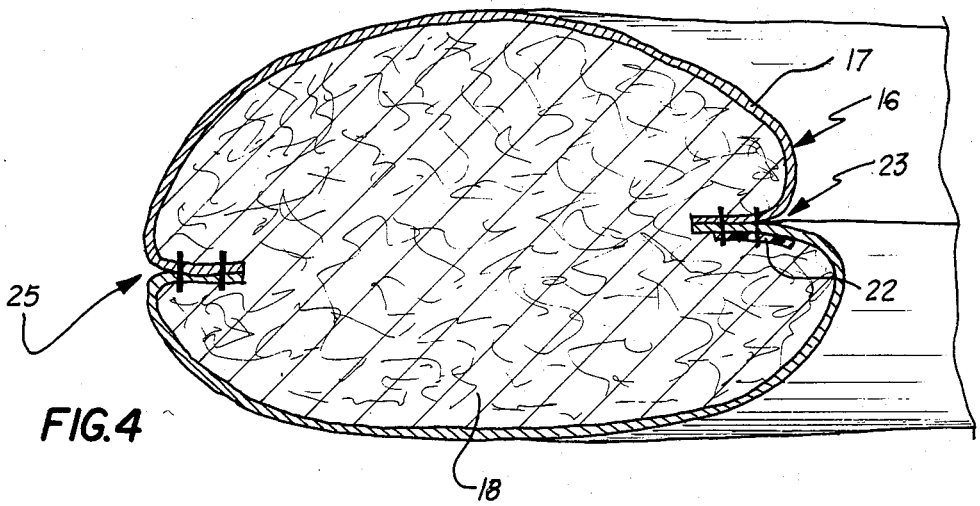
FIG. 4 is a sectional view of the figurine of FIG. 1, taken through one of the coils of the figurine.

A relatively soft, compliant, filling 18 is disposed inside the fabric 17 that forms the outer covering 16 (see FIG. 4). The filling 18 can be formed of numerous soft, compliant fill materials, including cotton, nylon, polyester fiber fill, etc. As seen from FIG. 4, the fill material 18 substantially fills the inside of the tubular outer covering 16.

In this application, reference to a "tubular outer covering" refers to the covering that makes up part of the form retaining body portion of the figurine. If desired, that body portion can have additional covering(s) that change or enhance its outward appearance.

A longitudinally extending piece of elastic 22 is secured to the tubular outer covering 16 at at least two points along the longitudinal length of the tubular outer covering 16. In the disclosed embodiment, the piece of elastic 22 is preferably a band of elastic that extends longitudinally along the entire coiled length of the body portion 14. It is fixedly secured to the fabric 17 forming the outer covering 16 by sewing it to the fabric 17 along the inner seam 23 (as schematically represented by the "X's" in FIG. 3). Thus, the piece of elastic 22 is also coiled, and is securely sewn continuously along its longitudinal length to the fabric 17 forming the tubular outer covering 16.

When the piece of elastic 22 is sewn to the inner seam 23 of the tubular outer covering 16, it is being maintained in a stretched condition, under a state of relatively high tension. After the piece of elastic 22 is securely fixed to the tubular outer covering 16, the external means that holds it in a state of tension is removed. The piece of elastic 22 can then partially relax, to a partially tensioned state, but does not return to a completely relaxed state. As it relaxes, the piece of elastic 22 applies forces to the tubular body portion 14 that biases the tubular body portion 14 to a tightly coiled form. Eventually, the piece of elastic 22 brings the body portion 14 to an equilibrium condition in which (i) the piece of elastic 22 is maintained in a partially tensioned state, and (ii) the piece of elastic 22 applies forces to the body portion 14 that biases the body portion 14 to a predetermined, coiled condition.

Figure 6:
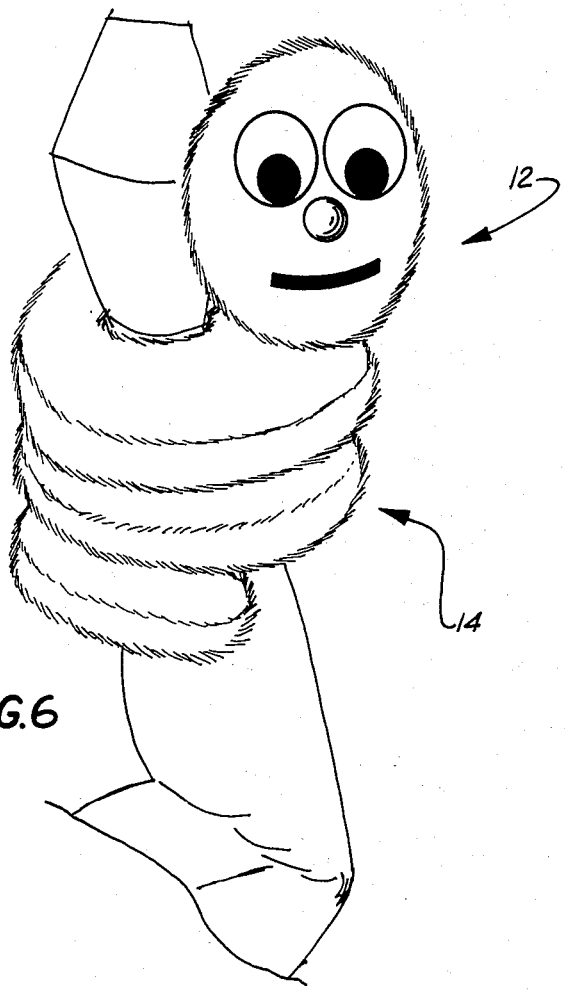
FIG. 6 schematically illustrates a coiled figurine, formed according to the principles of this invention, gripping the arm of a person.
Figure 5:
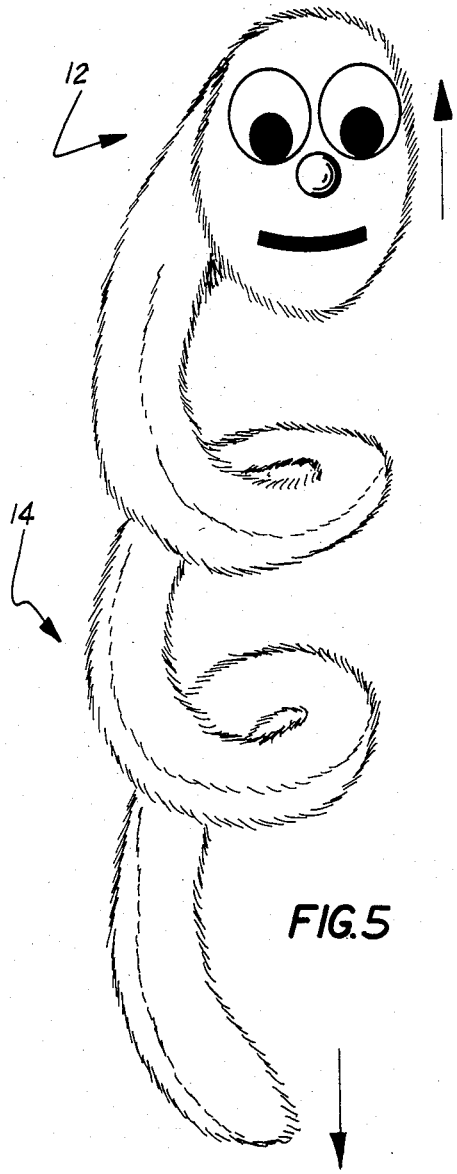
FIG. 5 schematically illustrates the manner in which a coiled figurine according to this invention can be distorted from its coiled state.

The body portion 14 can be deformed, against the bias of the piece of elastic 22, by application of manual force. When the deforming force is removed, the piece of elastic 22 returns the body portion towards its predetermined coiled condition. For example, the body portion can be uncoiled, as shown in FIG. 5, and then simply released. The piece of elastic 22 will return the body portion to its original coiled configuration. The body portion can also be partially uncoiled, and then wound around an object such as a person's arm, as shown in FIG. 6. The body portion, due to its bias toward its coiled condition, will coil about the object and exert a secure gripping action on the object.

Figure 2:
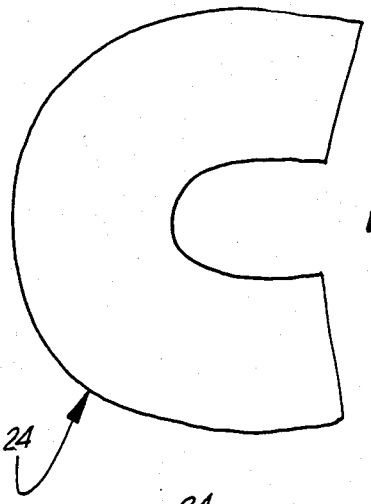
FIG. 2 is a schematic illustration of a C-shaped pattern piece used in forming a coiled figurine according to the principles of this invention.
Figure 3:
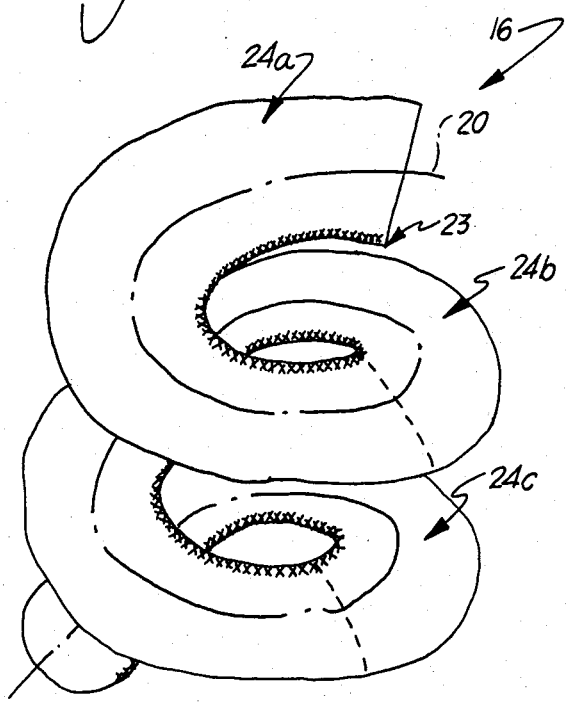
FIG. 3 is a schematic illustration of the coiled body portion of the figurine of FIG. 1, illustrating the location where the elastic member is sewn to the body portion.

According to the preferred embodiment, the tubular outer covering 16 is formed by connecting together several specially formed pattern pieces 24 of the fabric material. The pattern pieces 24 are each C-shaped, when viewed, in plan, from an end of the coil (see FIG. 2). They may also be formed into partial spirals or coils, as seen from FIG. 3, and several of the pattern pieces are be connected together to form the entire coiled outer covering. In FIG. 3, the pattern pieces are identified by the numerals **24*a*, 24*b*, 24*c*, and are connected (sewn) along the dotted lines to form the coil. In this application, reference to a "C-shaped" pattern piece means "C" shaped, when viewed, in plan, from an end of the coil (FIG. 2**), but which can also be formed into a partial spiral shape.

Figure 7:
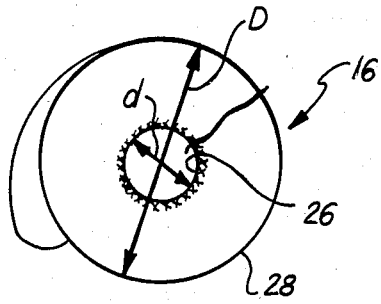
FIG. 7 is a view of the coiled figurine of FIG. 1, taken from the direction 7—7, with the head portion omitted.

When the C-shaped pattern pieces 24 are secured together, the finished coiled product has an outer periphery 28 of diameter "D" and an inner periphery 26 of diameter "d" (FIG. 7). As seen from the foregoing discussion, the piece of elastic 22 is sewn, under tension, along the inner seam 23 of the coil. When that piece of elastic partially relaxes, it provides a state of tension along the inner seam 23 that biases the tubular body portion 14 to a substantially circular coiled configuration, having a relatively constant inside diameter d. The bias provided by the piece of elastic 22 resists deformation by uncoiling (FIG. 4), and biases the coils back toward the condition of FIG. 1. It provides a secure gripping action when coiled about an object such as a person's arm (FIG. 6).

Thus, the preferred embodiment of this invention provides a unique way of creating a form retaining figurine, particularly a coiled form retaining figurine. Moreover, the principles of this invention are believed applicable to forming other form retaining toys. For example, the figurine may depict a stuffed doll or animal, and the limbs (arms, legs) of the figurine can be biased to a hugging shape. The elastic can be sewn under tension to a tubular outer covering to bias the stuffed figurine to that hugging shape.

The fill material is compliant, in the sense that it makes the body portion soft enough to be squeezed. However, the fill material does not have to have any special form of inherent resiliency to bias the body portion toward a pedetermined form. The preferred embodiment utilizes polyester fiber fill, but it is contemplated that various other fills, (e.g., nylon, cotton, fiber fills, etc.) may also be suitable.

The fabric that forms the outer covering is compliant, in the sense that it can be manipulated into a predetermined tubular form. It may have some inherent elasticity, or may be essentially inelastic, since the elasticity of the figurine is essentially provided by the band of elastic, and the geometry of the pattern piece(s).

A particular advantage of the present invention is that it allows the outer covering and the fill material to be made of many different types of materials, because the elastic properties of the figurine do not depend on the elastic properties of those materials. Indeed, the invention is adaptable to forming an elastically deformable figurine with a tubular outer covering formed of a fabric that is substantially inelastic, as well as a fill material that is also substantially inelastic. Thus, the invention can be made of fabric and fill materials that are quite inexpensive. Moreover, as seen from the preferred embodiment, the invention can be used to form fairly complex shapes which have both unique eve appeal as well as secure gripping capabilities. The shapes can be changed to a new form as easily as new pattern pieces for defining those shapes are worked out.

What is claimed is:

1. A stuffed figurine having a head portion and a form retaining body component; said form retaining body component comprising a tubular, longitudinally extending outer covering of a compliant fabric material that is secured along a seam; said seam extending parallel to the longitudinal extent of said covering, and a soft, compliant fill material being disposed within said tubular outer covering; a length of elastic fixedly secured to and extending longitudinally along said seam along at least part of said tubular outer covering; said length of elastic being held by the tubular outer covering in a partially tensioned state; said length of elastic fixedly secured to at least two longitudinally spaced portions of said longitudinally extending tubular covering; said length of elastic when in said partially tensioned state resiliently biasing said form retaining body component into a predetermined geometric form; wherein said tubular outer covering has its longitudinal extent biased into an arcuate shape and with said tubular outer covering having an inner periphery and an outer periphery, said length of elastic being confined to and extending along said inner periphery, said form retaining body component being deformable against the bias of said length of elastic, and said length of elastic causing said form retaining body component to return to its predetermined geometric form when the forces causing the deformation are removed.

2. A figurine as set forth in claim 1 wherein said length of elastic is sewn to said compliant fabric material along said seam.

3. A figurine as set forth in claim 2 wherein said tubular outer covering comprises a plurality of sections, each of compliant fabric material, that are sewn together.

4. A figurine having a coiled, form retaining shape comprising a body portion having a coiled shape and a head portion connected with the body portion; said body portion comprising (i) a tubular outer covering of compliant fabric material having a coiled shape wherein said coils of said tubular outer covering have an inner periphery and an outer periphery, said tubular outer covering having a seam extending along the coils of said tubular outer covering, (ii) a soft, compliant fill material substantially filling said tubular outer covering, and (iii) a length of elastic having a coiled configuration and extending along said seam along at least a part of said tubular outer covering; said length of elastic being fixedly secured to the inner periphery of the tubular outer covering and extending along the inner periphery of the coils of the tubular outer covering; said length of elastic being held by the tubular outer covering in a partially tensioned state; said length of elastic being fixedly secured to the inner periphery of the tubular outer covering; said length of elastic resiliently biasing said coiled body portion into its coiled shape; and said length of elastic allowing the coiled body portion to be manually deformed and then returned to a coiled shape.

5. A figurine as defined in claim 4 wherein said seam extends along the inner coiled periphery of the tubular outer covering, and said length of elastic extends longitudinally and is sewn to the tubular outer covering along the seam.

6. A figurine as defined in claim 5 wherein said tubular outer covering comprises a plurality of pattern pieces that are connected together, each pattern piece having a C-shaped pattern.

7. A figurine as defined in claim 6 wherein said C-shaped pattern pieces are sewn together.

8. A form retaining figurine comprising a head portion and a body portion; said body portion comprising (i) an outer covering of compliant, fabirc material, said outer covering having a coiled shape comprising a plurality of coils having an inner periphery and an outer periphery, said outer covering having a seam extending along the coils of the tubular outer covering, (ii) a soft, compliant fill material disposed within said outer covering, and (iii) a length of elastic fixedly secured to and being confined to the inner periphery of said outer covering and extending along the seam thereof; said length of elastic being held by the outer covering in a partially tensioned state in which it resiliently biases said plurality of coils to a condition in which they have a common inside diameter; said coils beng deformable against said resilient bias, whereby the figurine is returned to a coiled configuration when the deformation forces are removed.

9. A form retaining figurine as defined in claim 8 wherein said outer covering comprises a plurality of pattern pieces that are connected together, each pattern piece having a C-shaped pattern.

10. A form retaining figurine as defined in claim 9 wherein said C-shaped pattern pieces are sewn together.

* * * * *